United States Patent [19]

Hackmann et al.

[11] Patent Number: 5,018,644

[45] Date of Patent: May 28, 1991

[54] DISPENSER FOR THE DISPENSING OF INDIVIDUAL TABLETS

[75] Inventors: Ludger Hackmann; Josef Wilken, both of Lohne/Oldenburg, Fed. Rep. of Germany

[73] Assignee: Bramlage Gesellschaft mit beschränkter Haftung, Lohne/Oldenburg, Fed. Rep. of Germany

[21] Appl. No.: 361,025

[22] Filed: Jun. 2, 1989

[30] Foreign Application Priority Data

Jun. 9, 1988 [DE] Fed. Rep. of Germany ... 8807522[U]
Dec. 22, 1988 [DE] Fed. Rep. of Germany ... 8815878[U]

[51] Int. Cl.[5] ..... B65D 83/00

[52] U.S. Cl. ..... 221/65; 221/152; 221/263; 221/266

[58] Field of Search ..... 221/65, 151, 152, 263, 221/266; 222/361, 366, 362, 363, 336, 339, 444, 449, 451, 453, 510; 206/528, 536, 540

[56] References Cited

U.S. PATENT DOCUMENTS

| | | | |
|---|---|---|---|
| 3,968,902 | 7/1976 | Bachmann | 221/263 |
| 4,564,124 | 1/1986 | Burton | 221/263 |
| 4,767,023 | 8/1988 | Hackmann et al. | 221/152 |

FOREIGN PATENT DOCUMENTS

| | | | |
|---|---|---|---|
| 345413 | 1/1989 | European Pat. Off. . | |
| 3307670 | 9/1984 | Fed. Rep. of Germany . | |
| 3416681 | 11/1985 | Fed. Rep. of Germany . | |
| 507848 | 7/1971 | Switzerland . | |
| 2013636 | 8/1979 | United Kingdom | 221/263 |
| 2108086 | 5/1983 | United Kingdom . | |

*Primary Examiner*—David H. Bollinger
*Attorney, Agent, or Firm*—Martin A. Farber

[57] ABSTRACT

A dispenser for the dispensing of individual tablets has a housing (1), a slide (3) displaceable with limited stroke, a tablet storage chamber with adjoining delivery chute (7), and front end closure surfaces and profiled flanks being developed, in part, fixed on the housing and, in part, on the slide (3). A moveable flank forms a separation chamber (A) and in the flank fixed on the housing has a separation finger (F) associated with the separation chamber. To obtain a structurally simple dispenser with optimal functioning and gentle treatment of the tablets, the separation finger (F) is formed by a bottom vertex (22) of a first oblique surface (I) which commences on top opposite an upper closure (23) of the separation chamber (A). A second oblique surface (II) is developed on the moveable flank (d), which surface, commencing at the upper closure (23) of the separation chamber (A), extends in upward direction, continuously increasing the cross-section of the delivery chute.

28 Claims, 12 Drawing Sheets

V
E
2
6
7
26
c
St
23
2'
I
F
22
E
27
III
AT1
25
24
II d
3
3'
1
α
β
γ

2
6
7
I
F
2'
III
A
25
II
1

2
6
7
I
F
22
E
27
2'
A
II
3
3'
1

6
7
D
I
F
2'
A
III
T2
II
1

FIG.12
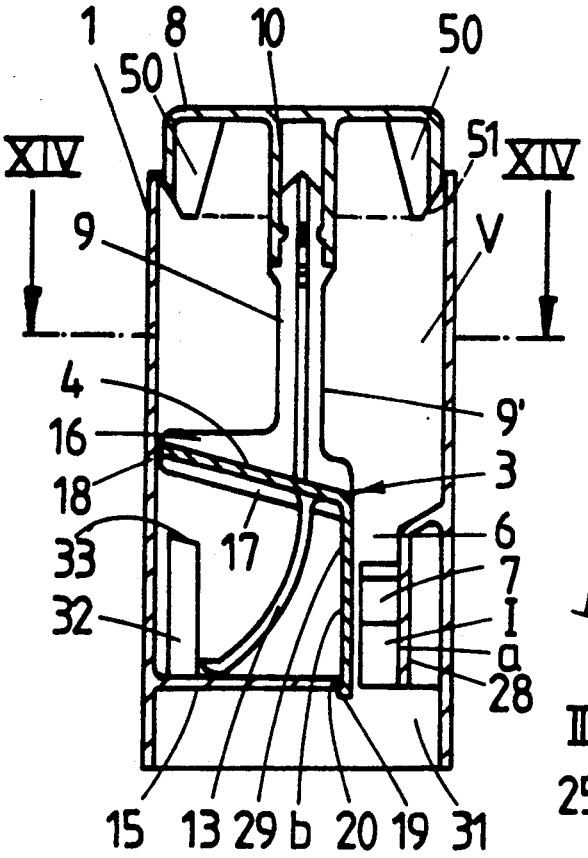
FIG.13
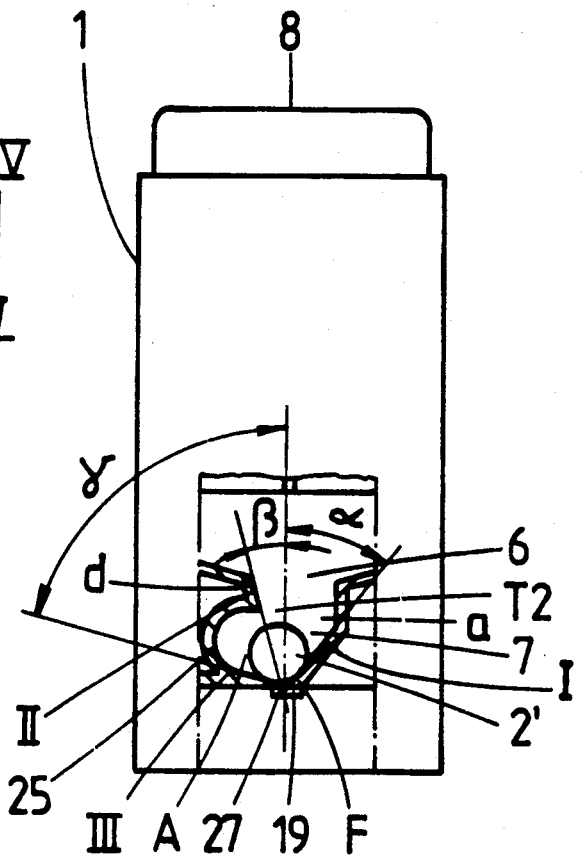
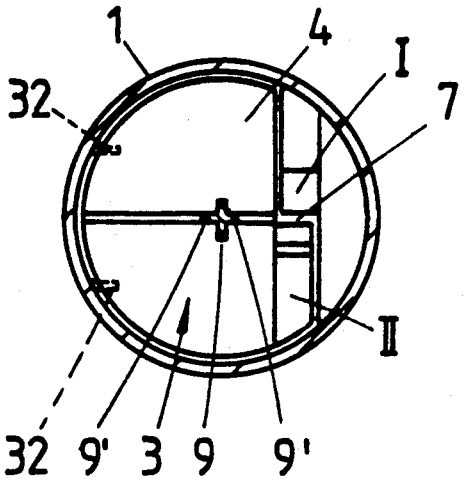
FIG.14

FIG.16
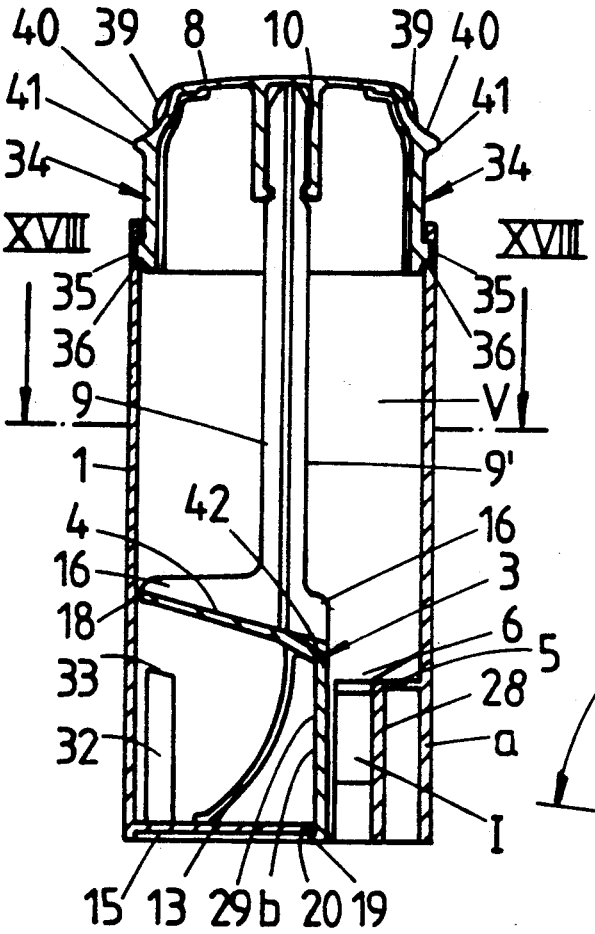
FIG.17
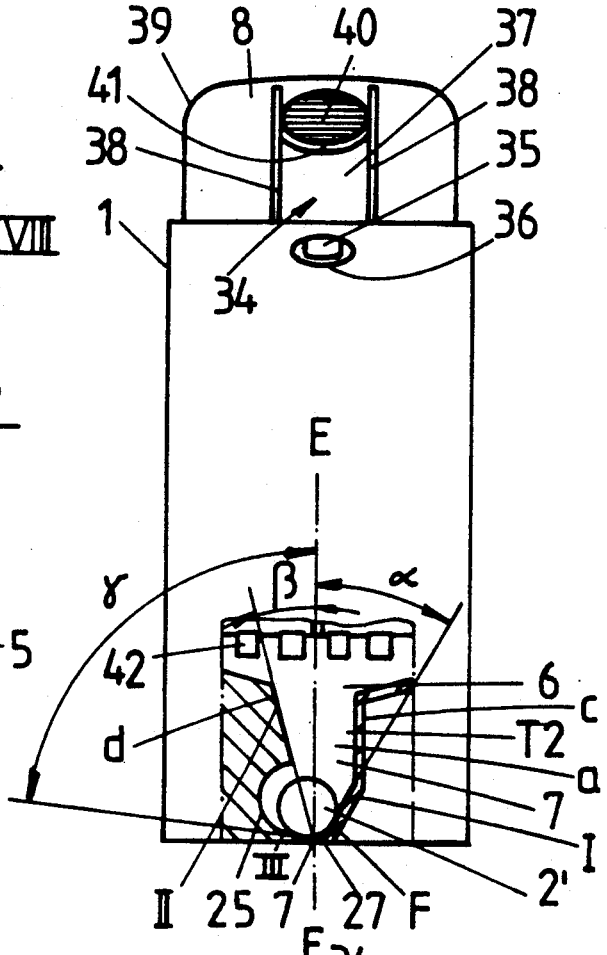
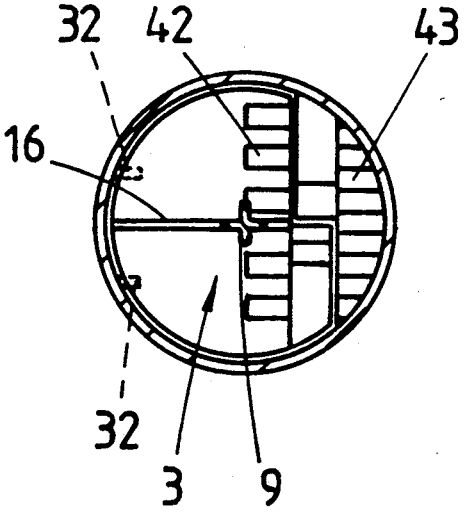
FIG.18
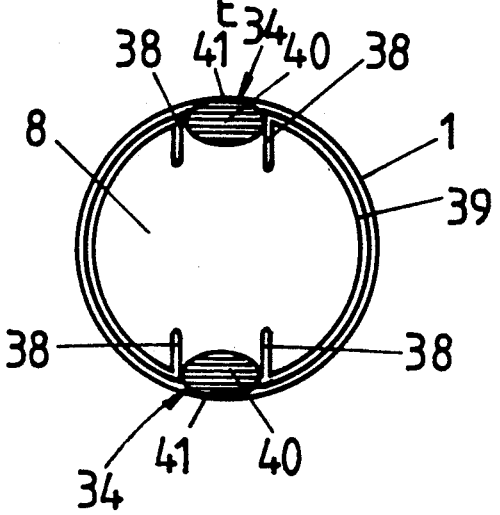
FIG.19

FIG. 23
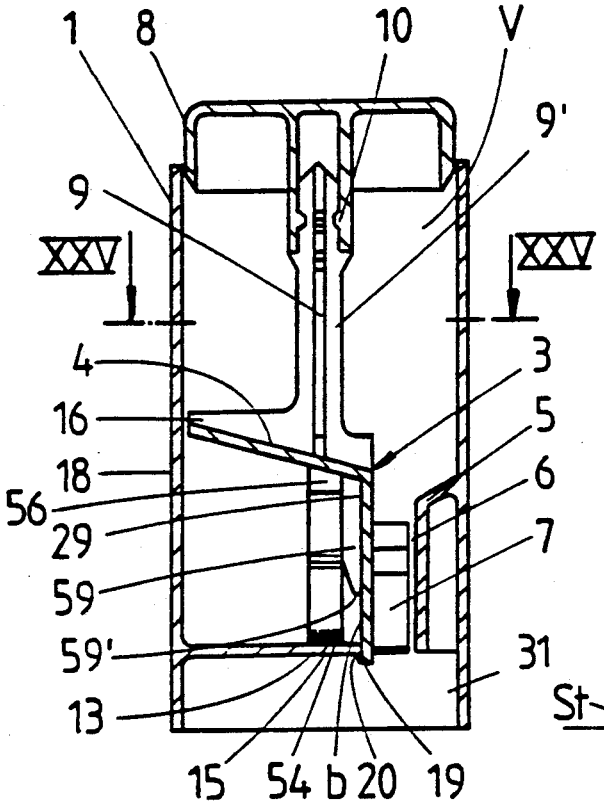
FIG. 24
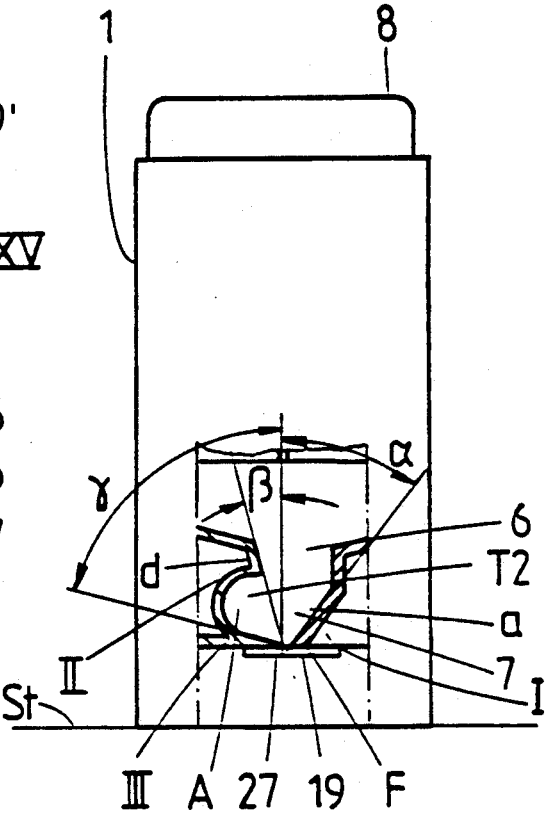
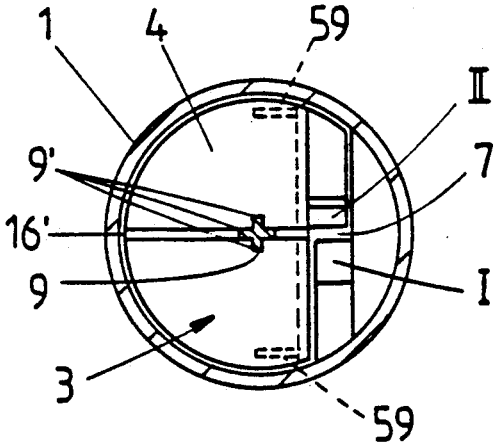
FIG. 25
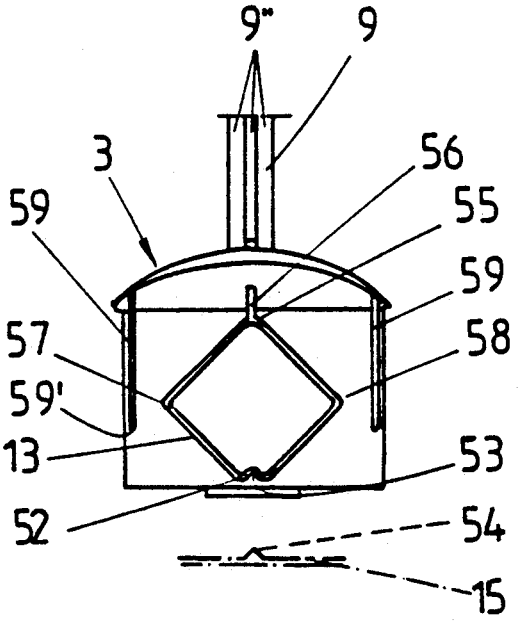
FIG. 26

FIG.28
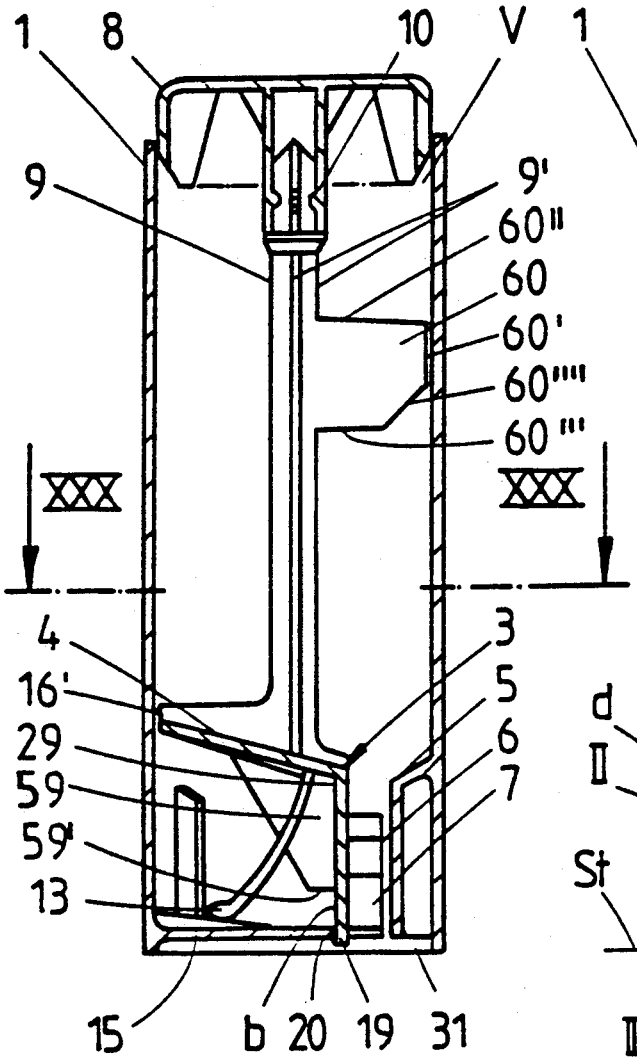
FIG.29
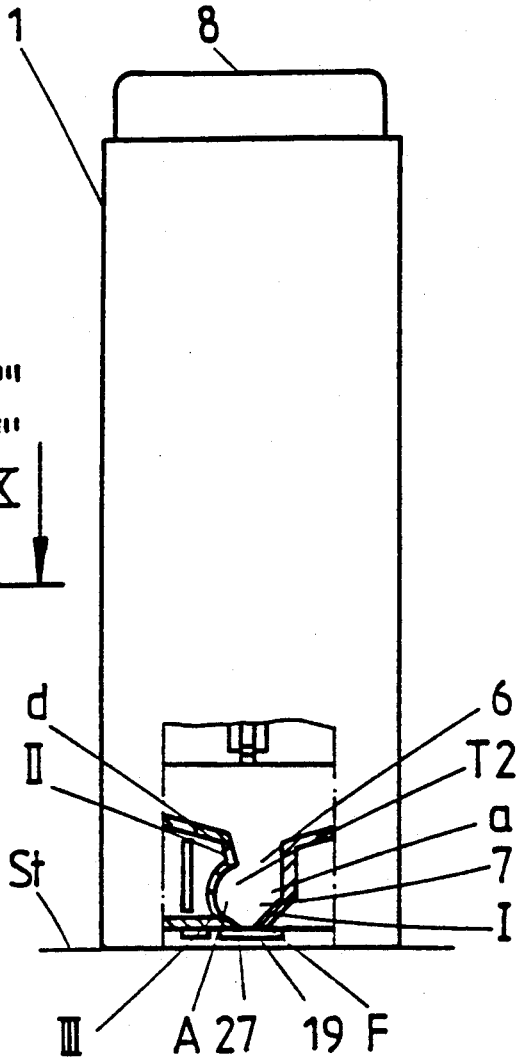
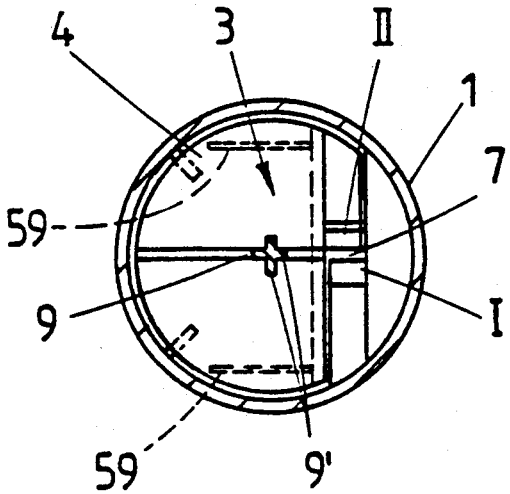
FIG.30
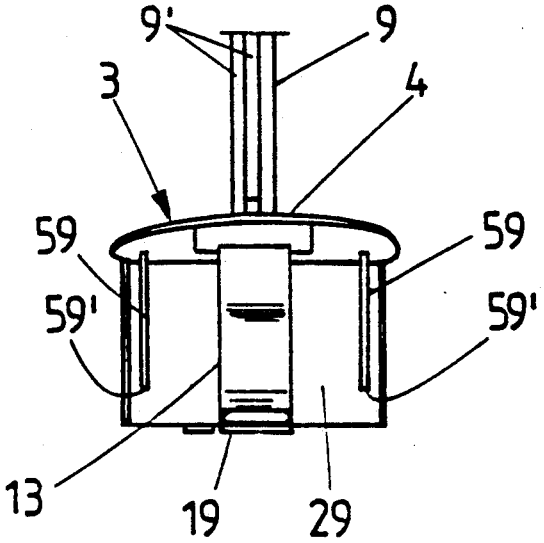
FIG.31

DISPENSER FOR THE DISPENSING OF INDIVIDUAL TABLETS

FIELD AND BACKGROUND OF THE INVENTION

The invention relates to a dispenser for the dispensing of individual tablets, the dispenser having a housing, a displaceable slide limited in stroke and a tablet storage chamber with adjoining delivery chute; front end surfaces and profiled flanks being developed, in part, fixed on the housing and, in part, on the slide; and a separation chamber being furthermore developed in a moveable flank, and a separation finger associated with the separation chamber being developed in the flank fixed on the housing.

A dispenser of this type is known from German OS 34 16 681. A tablet which is present in the separation chamber and therefore ready for immediate dispensing is in that patent document in the same plane as the bottom side of the dispenser. To this extent, there is contamination with the resting surface. Furthermore, a touching thereof upon handling the dispenser cannot definitely be excluded.

Another general problem in such a dispenser is the obtaining of a dependable individual portioning. A combination of several unfavorable factors, such as a mechanical stressing of the tablets due to a lengthy period of dispensing, splinters from breakage, and manufacturing tolerances both of the portioning mechanism and of the tablets, can limit the dependability of the dispenser even though a certain pre-alignment of the portion of the tablets which are ready for immediate dispensing is practiced. There also takes place, for instance, a self-blocking by a bridging configuration of such tablets ready for dispensing, so that the user time and again has recourse to shaking the dispenser, which, in turn, considerably increases the danger of breakage, particularly in the case of only weakly compacted tablets.

SUMMARY OF THE INVENTION

It is therefore the object of the present invention to develop a dispenser of the type described which is easy to manufacture and reliable in use, in such a manner, that on the one hand the undesired exposure of the tablet which is ready for immediate dispensing is avoided and, on the other hand, an extremely gentle portioning without danger of pressure is assured.

This object is obtained by the invention wherein a separation finger (F) is formed by a vertex (22) on the bottom side of a first oblique surface which commences on top opposite the upper closure (23) of the separation chamber (A), and that a second oblique surface (II) is developed on a moveable flank (d) which surface, commencing at the upper closure (23) of the separation chamber (A), extends in upward direction and continuously increases the cross-section of the delivery chute.

The ensuing text and claims disclose advantageous further developments of the dispenser according to the invention.

As a result of such development there is obtained a dispenser of the forgoing type which is of increased utility. There results a perfect dispensing of individual tablets which is practically free of jamming. The user no longer must loosen up the tablets by shaking. Accordingly, the danger of breakage is very substantially reduced. Furthermore the hygienically objectionable partial exposure of the tablet which is directly ready for dispensing is done away with. The structural means are simple and functional.

One proceeds in the manner that the separation finger is formed by a bottom-side tip of a first oblique surface which on the top side commences opposite an upper closure of the separation chamber and that a second oblique surface is formed on a moveable flank. The second oblique surface, commencing at the upper closure of the separation chamber, extends upward while continuously increasing the cross section of the dispensing chute. The providing of a first oblique surface not only results in a gentle surface-tangent supporting of the tablet ready for immediate dispensing but it also holds the tablet at a greater distance from the resting surface of the dispenser. The unsatisfactory covering, mentioned above, is thus done away with. For this reason alone the acceptance of such a dispenser is increased.

However, also the other elements of the combination of features of the solution described create a gentle dispensing and loosening transport of the tablets, in which connection predominantly surface-tangent contact and guidance support are present in the profile of the dispensing chute. The mechanical stressing of the tablets thus becomes tolerable. In particular, an additional oblique surface in the region of the moveable flank results in a holding back of the next-to-last tablet superimposed on the dispensing of the tablet ready for immediate dispensing on which the next to last tablet rests, until the last moment, i.e. until the first and second oblique surfaces have made the sluice-like passage so narrow that the next-to-last tablet is held back dependably and, above all, free of pressure.

The return movement, i.e. the closing of the separation chamber, results in a slight and again gentle upward displacing of the row of tablets extending in front of the separation chamber. This, as well as the fact that the cross-section of the dispensing chute increases continuously in upward direction (approximately to about one and one-half times the diameter of the tablet), eliminates any possible bridging configuration of the tablets. The hygienic bottom closure is made optimal by the fact that a run-off bevel of the separation chamber and the first oblique surface, in the basic position of the dispenser, form in cross section a funnel which is almost closed at the bottom. The funnel contour results in an even greater spacing away from the resting surface of the dispenser.

It furthermore proves to be advantageous that the second oblique surface and the first oblique surface, in actuated state, form in cross section a funnel which is closed to an extent less than the diameter of the tablet. This alignment of the surfaces, which in each case converges in downward direction, also has the advantage, however, of less dependence on the size of the tablet, i.e. tablets which have, for instance, been reduced in size by abrasion are subjected to the same precise portioning as freshly filled ones. Abraded tablets merely lie somewhat lower and therefore closer to the bottom of the funnel than tablets having a larger diameter.

An advantageous development which creates a practically zig-zag-shaped row of tablets can be achieved with simple means in the manner that a limiting surface of the delivery chute, which surface is fixed to the housing, adjoins the first oblique surface in upward direction and, in unactuated state, lies opposite the second oblique surface, subsequently extends vertically (vertical with respect to the resting surface of the dispenser).

The following details have proven to be favorable developments with respect to the profiled flanks of the delivery chute: The first oblique surface and the second oblique surface form with a central plane of the chute in each case an acute angle Alpha or Beta, the angle Beta being smaller than Alpha. In addition, the run-out bevel forms an acute angle with the center plane of the chute which is larger than the angle Alpha. With the, in any event, falling alignment of the row of tablets, this favors the rolling-out movement and even results in a certain tendency towards ejection.

Furthermore, it is proposed for a dispenser the slide bottom of which on the storage-chamber side takes up about two-thirds of the cross section of the storage chamber, that the slide be connected via a central actuating shaft to an actuating button and that the side wall of the storage chamber be formed by the housing. This leads to the predominant portion of the stored quantity being included in the lowering and restoring movement of the slide, which has an additional advantageous loosening effect which is particularly welcome in the case of slightly adhering tablets. The storage chamber consists to this extent of wall sections which are moveable relative to each other, the side wall being a stationary part. The central position of the actuating shaft leads to a favorable introduction of force upon actuating the dispensing.

It is advantageous with respect to stability for the actuating shaft to have a cross section in the shape of a cross. Without increasing the quantity of material, this results in projections which extend radially into the stored material. It is advisable, in this connection, with respect to stability, to have two legs of the cross continue into a ledge which divides the bottom of the slide on the storagechamber side. This results furthermore in an advantageous connection or transition region between the rather narrow actuating shaft and the large bottom of the dispenser. The corresponding development is further optimized by a structural measure, namely by developing the bottom of the slide in the shape of a trough and by having the ledge extend in descending fashion on the bottom of the trough, i.e. aligned with the delivery chute. This creates two areas of feed and therefore a good distribution of the stored material over the collecting shaft extending below it which shaft is positioned between the delivery chute and the storage chamber.

It is furthermore of advantage that the slide has a vertical wall below the slide bottom and aligned with the ledge which wall is guided with its peripheral longitudinal edge on the corresponding inner surface of the housing. It is finally advantageous that the housing is closed on the bottom, except for an opening for the slide head, by a transverse wall which forms with its upper side the support for a restoring spring formed on the slide and developed as a leaf spring.

In order, despite the high reliability in use, nevertheless to take into account the problem of safety in use, particularly with respect to persons requiring protection, it is further proposed, in the case of a dispenser for the dispensing of individual tablets having to employ a housing, a slide displaceable with limited stroke and a tablet storage chamber with adjoining delivery chute and in which front end closure surfaces and profiled flanks are in part formed fixed on the housing and in part on the slide with the development of a separation chamber. This provides for slide detent elements which can be disengaged substantially perpendicularly to their direction of displacement against spring force and which are to engage in safety recesses in the housing in unactuated condition.

The portioning can be effected intentionally only with a combination of the actuating steps of displacement of the spring projections and subsequent displacement of the slide. The fact that for this purpose pressure must be exerted in two different planes and three directions makes it more difficult and not readily possible for children or the elderly. The construction is carried out advantageously in the manner that the detent elements are formed by lugs cut free from a cup-shaped slide-actuating button. The slide head developed in this manner has, in this connection, practically three functions: The cup-shape can be used to obtain a top closure of the dispenser; in addition there is the intended use as actuating button and then there is the function of the parts which contribute to making the device child-proof.

In order to further differentiate the actuation, the invention proposes, in addition, to form the detent elements at diametrically opposite places. In this way, thumb and middle finger are, for instance, required to displace the detent elements, the index finger taking care of the actuation in the direction of displacement.

It has furthermore proven advantageous to form concave actuating hollows in the lugs in the convex transition region from the bottom of the cup to the cup wall of the actuating button. These areas prove to be particularly non-resilient, so that correspondingly higher actuating forces must be exerted. The concave shape selected furthermore results in a slip-proof insertion of the fingers of the actuating hand. Furthermore, it is also proposed for the actuating groove to end in a projecting limiting bead on the cup-wall side of the actuating button which bead extends into the region of a theoretical extension of the housing wall. In this way, a limiting stop or additional limiting stop can be obtained with a corresponding adjustment of the stroke, so that the stop forces do not enter exclusively on the slide.

In order to be able to dispense with sliding displacement of the return spring so that one can get along with a rather small spring chamber, it is advantageous for the return spring to be developed as a circularly closed body. In this case, rather high spring forces can be applied, which effect a dependable returning of the slide into its basic position. As an alternative, it is proposed that the return spring be developed as a closed rhomboid-shaped body with one vertex resting against the transverse wall. Movements of evasion of this spring body are effectively prevented if it is furthermore provided that the vertex on the transversewall side be pulled into a support niche and seated on a bearing knife-edge of the transverse wall. A stable association of the spring member with the slide, which is nevertheless favorable for purposes of extrusion, results from the further measure that the vertex facing the transverse wall is connected, via a vertically extending arm, to the lower side of the slide bottom.

Furthermore, it is found to be favorable from a functional standpoint that the slide bear, in the region of its closure surface, a stop ledge which cooperates in limiting the slide stroke within the transverse wall. The supporting is effected in the plane of actuation; no tilting forces which lead to jamming can occur. This development is optimized by stop ledges, provided in pairs, which, extending perpendicular to the closure surface, are rooted in it and at the same time rooted, in corner-stiffening manner in the slide bottom, which adjoins it on top. In this way, the stop ledges even assume an additional function, in that they stabilize the angular profile of the slide in the lower region. It is, furthermore, favorable for the stop ledges to lie in the lateral end-regions of the stop surface, so that a balanced support loading is present.

From an assembly standpoint, it is advantageous, particularly in the event of rather long types of dispensers, that the shaft of the slide bear an axially extending, radially directed guide wing the longitudinal front surface of which rests against the inner wall of the housing. In this way, the upper free end of the shank of the slide, which is to be provided with the actuating button, is always held in the central basic position proper for assembly. There is obtained a blind assembling which is dependable at all times, the stop ledges defining the assembly basic position.

It is furthermore favorable that the guide wing extend from that side of the shaft of the slide which faces the separation chamber. In this way, there thus results a support guidance also on the side facing away from the slide bottom. Finally, it is also advantageous for the guide wing to lie in the upper region of the shaft of the slide. The guiding zones lie as far apart from each other as possible and/or the guide wing lies as close as possible to the region of attachment of the actuating button. Finally, it also proves favorable that the upper and lower edges of the guide wing converge slightly towards the outside, and that the lower vertex is beveled off. This holds the frictional forces to a minimum, and furthermore results in advantages with regard to removal from the mold.

BRIEF DESCRIPTION OF THE DRAWING

The subject matter of the invention will be explained in greater detail below by means of several illustrative embodiments shown in the drawing, in which FIG. 12 shows the dispenser developed in accordance with the invention in vertical section, according to the second embodiment, FIG. 13 is a side view thereof, partially cut-away, FIG. 14 shows a section along the Line XIV—XIV in FIG. 12, FIG. 16 shows the dispenser developed in accordance with the invention in vertical section, according to a third embodiment, FIG. 17 is a side view thereof, partially broken away, FIG. 18 is a section along the Line XVIII—XVIII in FIG. 16, FIG. 19 is a top view of FIG. 17, FIG. 23 shows the dispenser developed in accordance with the invention, in vertical section, in accordance with a fourth embodiment, FIG. 24 is a side view of this, partially cut open.

FIG. 25 is a section along the line XXV—XXV of FIG. 23,

FIG. 26 shows the corresponding slide by itself,

FIG. 28 shows the dispenser developed in accordance with the invention, in vertical section, in accordance with a fifth embodiment, FIG. 29 shows the side view of this, partially cut open, FIG. 30 shows a section along the line XXX—XXX of FIG. 28, FIG. 31 shows the slide by itself.

DETAILED DESCRIPTION OF THE PREFERRED EMBODIMENTS

Figure 3:
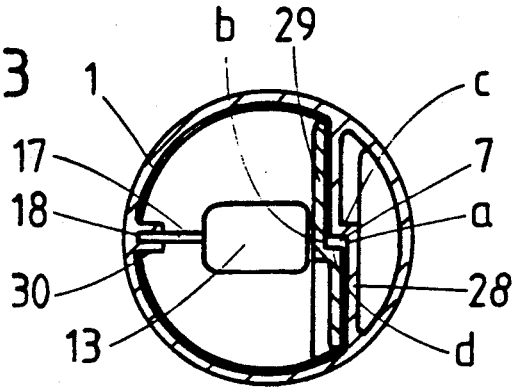
FIG. 3 shows a section along the Line III—III in FIG. 1.

The housing 1 of the dispenser shown, which with the greater part of its volume forms a storage chamber V, has a cylindrical cross-section. Its height is greater than its width. The storage chamber V receives a number of tablets 2. The individual dispensing of these tablets takes place via a slide 3. The latter is displaceable vertically and integrated with limited stroke.

The slide 3 forms, together with a slide bottom 4, a bottom closure of the storage chamber V together with a bottom section 5 on the housing. Both extend inclined downward in the direction of a collecting chute 6 in the shape of a flat V, followed by a delivery chute 7 which continues in downward direction.

The upper closure of the storage chamber V is formed by a readily accessible actuating button 8. The latter is connected to an actuating shaft 9 extending from the top of the slide bottom 4 and passing centrally through the housing 1.

The slide bottom 4 takes up about two-thirds and, in the embodiment shown, even three-fourths of the cross-section of the storage chamber. The corresponding adaptation to the circular cross section with a cross-sectional dimension exceeding the diameter results in a favorable guiding of the slide 3 in this region. On the top, the axial guidance is effected by the cup-shaped actuating button 8. The latter forms on the inside of its convexly upwardly arched cover a connection piece 10 for the corresponding end of the actuating shaft 9. It is possible to employ a detent connection. The detent projections 11 are seated on the actuating shaft 9. The mating detent means in the form of an annular groove 12 are located on the inside of the connection piece 10.

Figure 1:
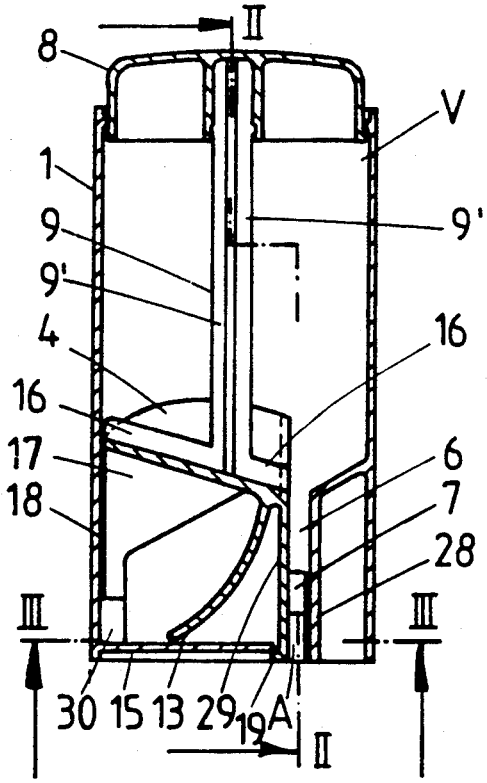
FIG. 1 shows the dispenser developed in accordance with the invention in vertical section, according to the first embodiment.
Figure 2:
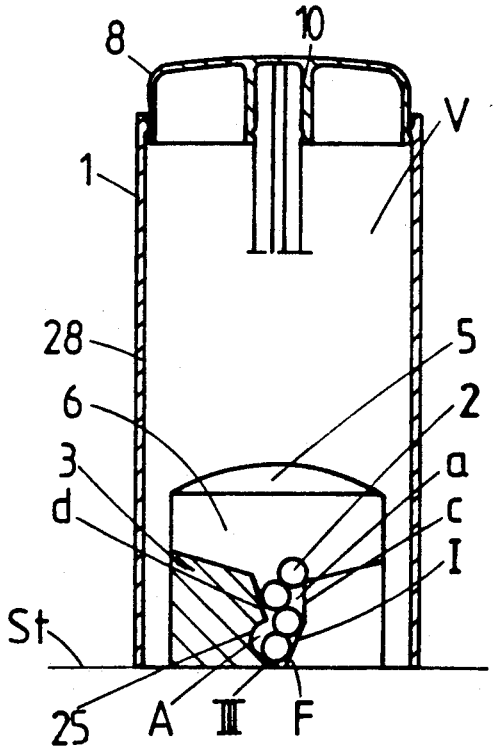
FIG. 2 shows the section along the Line II—II in FIG. 1.

In the direction of its basic position (FIG. 1) the slide 3 is under spring load. The corresponding spring force is applied by a leaf spring 13 which is integrally formed on the bottom side of the slide. As shown in the drawing, the latter is arranged hanging and slightly arched. It may be pre-stressed, for instance, by forming it in stretched position with the approximate position of stretch parallel to the actuating shaft 9. Its root 13 on the bottom of the slide is located near the collecting chute 6. Its free end rests on the transverse bottom 15 which is slightly set back extending from the resting edge 14. The transverse bottom forms the bottom closure of the dispensing mechanism. The slide 3 is accordingly assembled from the top.

Figure 4:
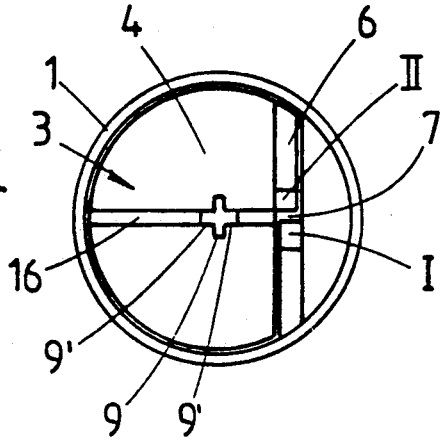
FIG. 4 shows a top view of the dispenser with the actuating button removed.

As can be noted from FIG. 4 the actuating shaft has a cross-shaped cross section. Two legs of the cross, designated 9', are rooted in an upwardly directed ledge 16 which divides the slide bottom 4 on the storage-space side. This results in a stable form-fitted connection between actuating shaft 9 and slide bottom 4. From the standpoint of stability it is furthermore advantageous for a vertical wall 17 to be formed also on the underside which wall extends congruously to the ledge 16, slides over or rests on the inner surface of the housing 1 with its peripheral longitudinal edge and possibly extends below into a U-shaped guide 30.

Figure 5:
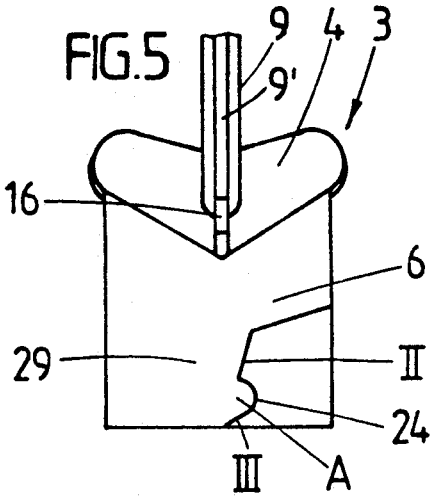
FIG. 5 is an individual showing of the slide.
Figure 6:
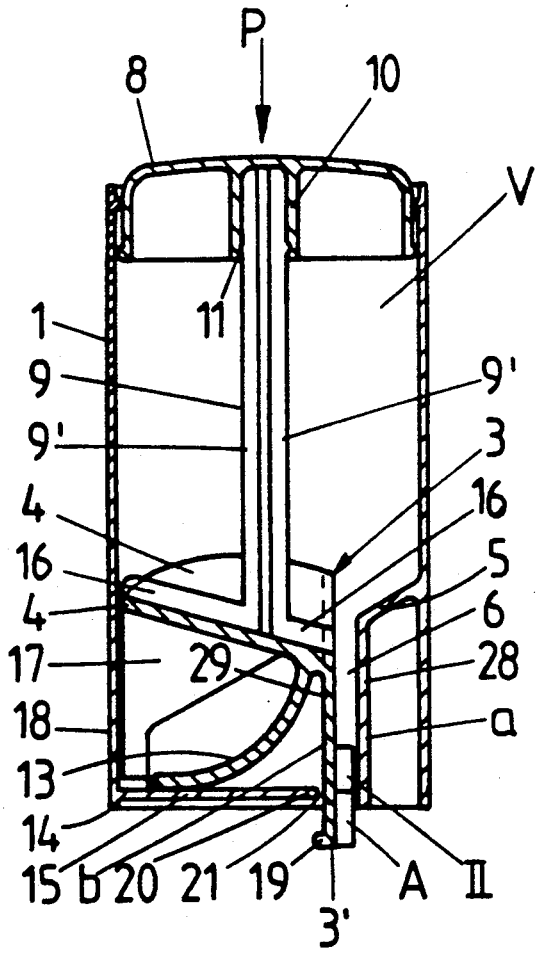
FIG. 6 shows a section according to FIG. 1 but during the dispensing.
Figure 7:
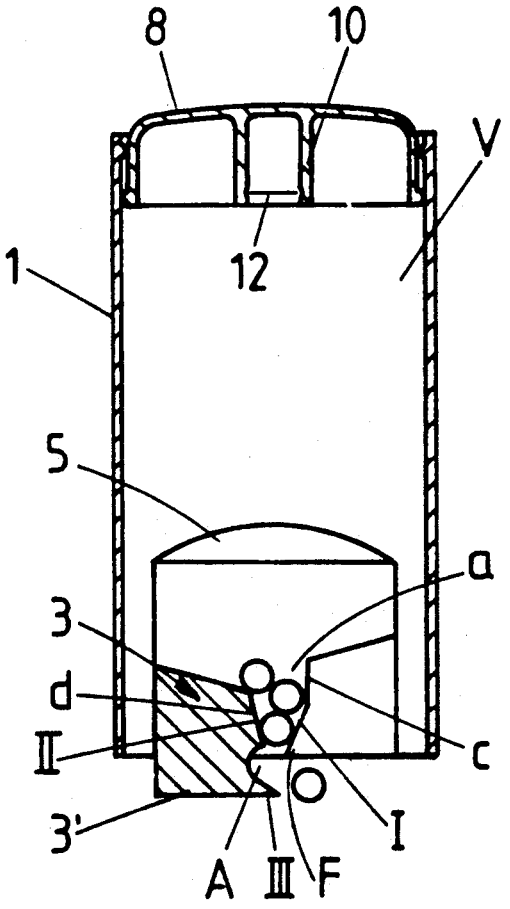
FIG. 7 shows the corresponding section as in FIG. 2, FIG. 8–11 are a motion study clearly showing the individual phases between the opened and closed positions of the slide.
Figure 8:
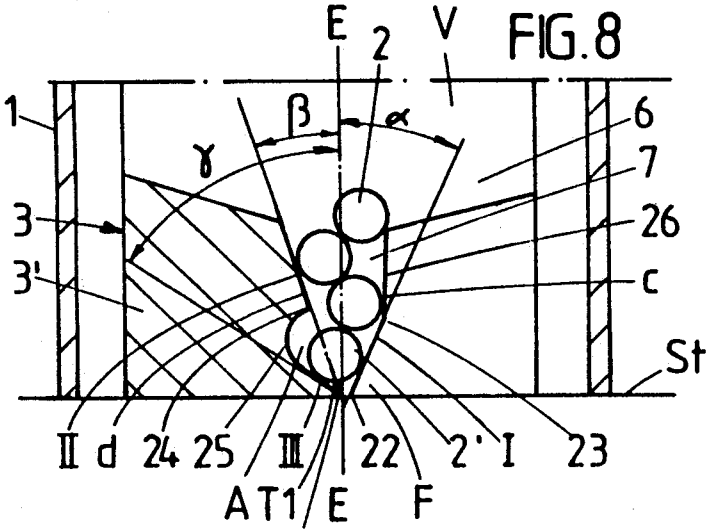

It can be particularly clearly noted from FIG. 5 that the slide bottom 4 is shaped like a trough. The flank angle of the upwardly diverging bottom halves is about 30°. The ledge 16 extends along the bottom of the trough and therefore diametrically. The amount by which they extend above the bottom of the trough corresponds approximately to the radially measured depths of the legs 9' of the cross. In addition to the trough-like shape, the slide bottom 4 is also shaped in downwardly inclined manner, i.e. the bottom of the trough descends in the direction of the collecting chute 6 which lies transversely in front of it and of the adjoining delivery chute 7.

The basic position of the slide 3 is defined by a lateral projection 19 which extends past a spring-side edge 20 of an opening 21 in the transverse bottom 15.

The individual portioning of the tablets 2 is based on a particular profiling of the dispensing mechanism, i.e. of the delivery chute 7. The disk-shaped tablets enter the chute upon edge and arranged one above the other. They assume the zig-zag course which can be noted, for instance from FIGS. 8–11. The delivery chute 7 is formed by a front end closure surface of the housing 1 and, extending parallel thereto, a front end closure surface b of the slide 3, circular broad surfaces of the tablets 2 rest against said end surfaces, and against profiled flanks c and d which are formed, in part, fixed on the housing and, in part, on the slide. The flank c is fixed on the housing and the other one is provided on the slide side; the profiled flanks face the cylindrical wall of the tablets. The moveable profiled flank d, and therefore the one provided on the slide 3, forms on the bottom a separation chamber A which is closed in the basic position of the dispensing mechanism and has associated with it a separation finger F formed on the flank c which is developed fixed on the housing.

With respect to the profiling of the flanks which form the delivery chute, one proceeds in the manner that separation finger F is formed by a bottom-side vertex 22 of a first oblique surface I the top of which starts approximately on a horizontal line opposite the upper closure 23 of the separation chamber A. Opposite thereto there is a second oblique surface II on the moveable flank d which surface commences at the height of the upper closure 23 of the separation chamber A, extends upward and continuously enlarges there the entrance of the delivery chute 7.

The separation chamber A, which is recessed in hollowlike manner in its upper part, passes via a vertex forming an angle of 90°, i.e. in the form of a nose-like corner or projection 24, into the adjoining, centrifugally arranged second oblique surface II. The hollow bears reference number 25. The course of its rounding corresponds at least to the circular contour of the cylindrical wall of the tablets 2. A run-off bevel III directly adjoins the groove 25 in downward direction.

The run-off bevel III of the separation chamber A and the first oblique surface I form, in the basic position of the dispenser (FIGS. 1 and 8) and seen in cross-section, a funnel T1 which is practically closed on the bottom. Due to the flank support, the tablet assumes a vertical distance from the resting surface St of the dispenser which is sufficient for avoiding any contact with said resting surface.

The second oblique surface II and the first oblique surface I then form, in the actuated condition of the dispenser and seen in cross-section, a funnel T2 which is closed to an extent less than the diameter D of a tablet. This leads to a gentle retention of the next-to-last tablet. Tablet 2', however, which is ready for immediate dispensing, is released. It rolls down on the run-off bevels III (see FIG. 11).

The upper end region of the delivery chute 7 is so developed with respect to the profiled flank c fixed on the housing that the delivery-chute limiting surface 26 fixed on the housing, which adjoins the first oblique surface I in upward direction and in non-actuated condition lies opposite the second oblique surface II, extends perpendicular to the resting surface ST of the dispenser. It may at most be inclined in a slightly opening manner for reasons of injection molding requirements. Both the limiting surface 26 and the first oblique surface I as well as the second oblique surface II and in principle also the run-off bevel III are all of equal length, the longitudinal part of III consisting of a part of hollow 25. Each of these lengths corresponds approximately to the inside diameter of the entrance to the delivery chute 7. This inside diameter corresponds to about one and one-half times the tablet diameter.

With respect to the inclines of the oblique surfaces, it is favorable to have them extend in such a manner (see FIG. 8) that the first incline I forms an acute angle Alpha of about 25° with a central plane E—E of the shaft. The second oblique surface II of the oblique surfaces I, II which converge downward, on the other hand, encloses an acute angle Beta of 20°. The extended flank line intersects the vertex 27 of the bottom of the separation chamber A. This bottom or the run-off bevel III defining it forms, on the other hand, an angle Gamma of about 50° with the vertical central plane E—E of the shaft.

The closure surface a is part of a vertical wall 28 in the shape of a circular segment which passes on top into the already above-mentioned descending bottom section 5 which is itself rooted in the wall of the housing 1 in the same way as the two end sections of the vertical wall 28, i.e. it is connected thereto by injection molding. The moveable vertical wall 29 of the slide 3, which is opposite the stationary vertical wall 28, constitutes the closure surface b of the slide and the profiled flank d thereof.

The function of the dispenser, briefly summarized, is as follows: By exercising a force in the direction of the arrow P, the slide 3 is lowered against spring force until it comes against a stop. In this way, the head 3' of the slide 3 moves increasingly into an exposed bottom position of the separation chamber A. The individual phases can be particularly clearly noted from FIG. 8. Tablet 2', which is supported in the funnel T1 and is ready for immediate dispensing, is first of all displaced transversely by the first oblique surface I in the direction of the throat 25 of the separation chamber A which groove forms a free space towards the rear. This relative displacement leads to a displacement of the tablets 2 extending above it and supporting each other on the flanks and in zig-zag sequence, and thus to a loosening.

Figure 9:
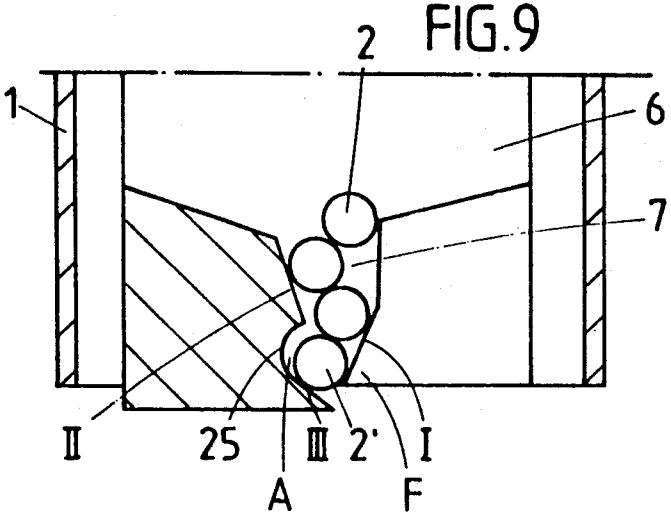
Figure 10:
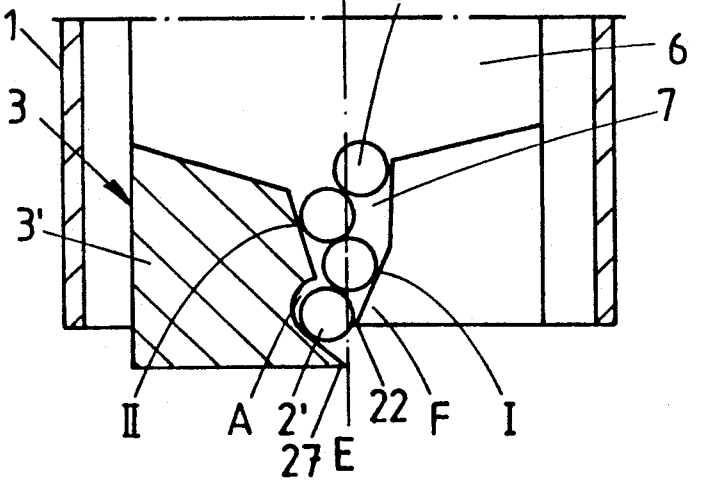
Figure 11:
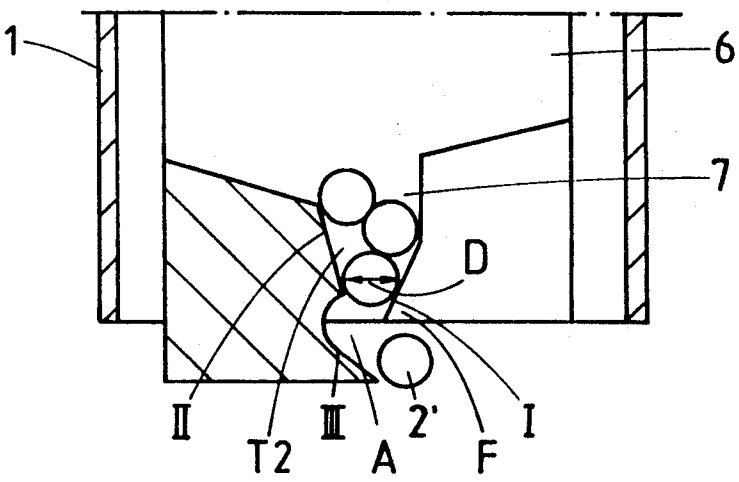

Simultaneously with the downward displacement of the slide 3, the nose-like vertex 24 of the second oblique surface II moves increasingly in the direction of the vertex 22 of the separation finger F (see FIG. 9). A further lowering increases the distance between the vertex 27 of the slide head 3' and the vertex 22 of the separation finger F and in superimposing fashion leads to a narrowing of the inside width between the vertex 24 of the slide head and the opposite oblique surface I. Even before the outlet delivery is opened to such an extent that the tablet 2' which is ready for immediate dispensing can leave the ramp-like run-off bevel III, the second funnel T2 has acquired a shape for protection of a tablet, the funnel retaining the next-to-last tablet 2 without exerting any pressure. Rather, the downward converging oblique surfaces I and II make it possible, as a result of the funnel shape, in the event of any possible horizontal force component, for the retained next-to-last tablet to move backward. Upon release of the slide, the second oblique surface II moves upward and increases the funnel opening so that the next-to-last tablet can now drop into the separation chamber A upon the attaining of a free space which corresponds to its diameter.

The upward or backward displacement of the slide 3 also leads to an additional loosening effect which continues into the collecting chute 6, etc. The inclines selected lead to a remainder-free dispensing of the contents of the dispenser.

All parts can be made of polystyrene; the length of the leaf spring 13 favors this, so that the relatively expensive POM-material can be dispensed with.

The embodiments according to FIGS. 12 to 15 and 16 to 20 are in principle of the same construction. The reference numbers have therefore been assigned analogously but without any extensive descriptive repetitions.

In the case of the second embodiment (FIGS. 12 to 15) there is a slight change in the separation geometry. With regard to the inclinations of the oblique surfaces there is favorable in that case, taking into account the tablet size shown in the drawing, an alignment (FIG. 13) such that the first oblique surface I forms an acute angle Alpha of about 40° with the central plane E—E of the shaft. The second oblique surface II of the downward converging oblique surfaces I and II, however, forms an acute angle Beta of about 18° to said reference plane. Also in this case the extended flank line intersects the vertex 27 of the bottom of the separation chamber A. Said bottom or the run-off bevel III defining it, on the other hand, forms an angle Gamma of about 75° with the vertical central plane E—E of the shaft.

In the case of the third embodiment (FIG. 16 to 20) the angle Gamma also amounts to about 75°, Beta amounts to about 18° and Alpha about 25°.

With regard to the further structural variations, the housing 1 or its wall extends, according to the second embodiment, downward beyond the transverse bottom 15. The amount of this extension corresponds to the stroke of the slide 3. This means that in actuating position the projection 19 no longer enters into a visible projecting position. The space 31, which is open in downward direction and has been created by said extension, could, for instance, receive a cup-shaped part so that the tablet falls into such a cup-shaped part. The tablet can thus be brought to its desired place without any contamination.

Furthermore, in the case of the second embodiment the vertical wall 17 of the slide has been realized in merely rudimentary fashion and is, in particular, no longer used for guiding the slide 3. It still has a merely stabilizing function with respect to the slide bottom 4.

Approximately at the place where the guide 30 was provided in the first embodiment, there is now in both additional embodiments a pair of parallel vertical ledges 32 spaced apart from each other. The latter are formed on the housing 1 and, with their upwardly directed end surface 33, form an upper stop for the slide 3 in order to limit the movement for the dispensing stroke. The limitation in the opposite direction is effected also in this case by the projection 19 of the slide 3. The latter comes, in the spring-loaded basic position of the slide, against the bottom side of the transverse bottom 15. On the other hand, the bottom side of the slide bottom 4 comes against the end surface 33.

The third embodiment shows how to secure the dispenser against use by children. For this purpose, the slide 3 forms, substantially perpendicular to its direction of displacement, detent elements 34 which can be disengaged against spring load. There are specifically projections 35 of oval cross-section which in disengaged position, i.e. in unactuated state, engage from the inside into safety recesses 36 of the housing 1 (FIG. 16).

The detent elements 34 are formed by lugs 37 cut free from the cup-shaped slide head, i.e. the actuating button 8. In the cylindrical wall of the cup there are two lugs 37. They are so arranged that the detent elements 34 are positioned at diametrically opposite places. The separating cuts which separate the lugs 37 from the remaining part of the wall of the cup and which are directed vertically and extend parallel to each other, bear the reference number 38. They are about a finger's width apart and extend into the bottom or, more precisely, into the cover of the cup-shaped part.

The transition region between the cover or bottom of the cup and the wall of the cup of the actuating button 8 is convexly rounded and designated 39. The ends of the separating cuts 38 present there extend into this convex transition region 39 and even somewhat beyond it into the slightly domed cover.

In the root region of the lugs 37, the detent elements 34 each form an actuating hollow 40 on the outside. These concave actuating hollows 40 therefore are arranged in the convex transition region 39. The hollows 40 are not merely indentations in the wall area of the transition region which are directed toward the inside of the cup; rather, the actuating hollows 40 extend on the side of the cup wall also into a protruding limiting bead 41 so that a snug insertion of the finger is assured. Also taking into account the main direction of the pressure actuation, the fingers can also not slip off from the actuating button 8 forming the slide head. As can be noted from FIG. 16, the protruding limiting bead 41 clearly extends beyond the general outside diameter of the actuating button 8, namely into the region of the theoretical extension of the housing 1, seen in upward direction. The axial distance between the upper, horizontal end of the housing 1 and the lower flank of the limiting bead 41 corresponds to the actuating stroke of the slide 3 as limited by stops, so that the limiting bead 41 can also perform the function of an additional limiting stop or else act by itself.

As can be noted from FIG. 17, the actuating hollow 40 has a elliptical contour with the longer axis of the ellipse being in the horizontal.

The safety recess 36 is also made elliptical with the longer axis of the ellipse access also being horizontal. The recess can again, for instance, also be effected exclusively from the inside of the housing 1 and therefore not be made as an opening. The size of the safety recess 36 takes into account the space required for the angling inward and outward of the projections upon actuation, so that no jamming occurs.

The actuating of the release of the child-proofing is effected by exerting a pressure in the direction of the base of the actuating hollows 40. Since the latter are located more in the root region of the lugs 37 which are cut free on the end, the actuating must be effected quite deliberately. The projections 35 then lift out of the safety recesses 36 which hold them in locking manner. Thereupon the displacement of the slide 3 in the direction of the arrow P can take place, which leads to the dispensing of a tablet in the manner described above in detail.

Upon release of the actuating button 8, the slide 3, which is under spring load, again moves into its basic position. The force of the leaf spring 13 is for this purpose made larger than the coefficients of friction of the detent elements 34 which rest with frictional engagement against the inner wall of the housing. In basic position they, i.e. their projections 35, again engage into the safety recess 36. The non-circular shape of the guided slide 3 assures that the engagement is in each case again effected with precision. A slight pre-stressing of the tongues 37 beyond the outside diameter of the actuating button 8 can be provided but is not required. The simple restoring force into the original cup shape of the actuating button 8 which is guided in the housing 1 is sufficient.

As can additionally be noted from the two further embodiments, the topside of at least the obliquely extending slide bottom 4 is provided with a toothing 42 which favors the entrance of the tablets into the V-shaped collecting chute 6. The tooth gaps are made in wedge shape in the direction of the rise in the slide bottom 4. The largest depth of a gap thus results in the plane of the vertical wall 29 of the slide 3.

A similar toothing can also be provided, as can be noted from FIG. 18, on the topside of the bottom section 5 on the housing.

The actuating hollow 40 is roughened. The roughening can be obtained by horizontal grooving.

Figure 21:
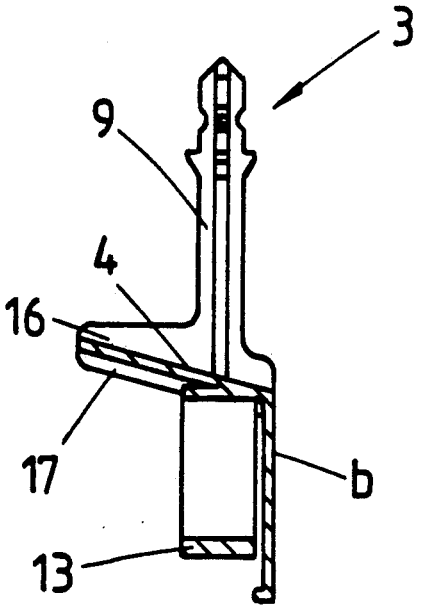
FIG. 21 is a cross-sectional showing of the slide in an alternative embodiment.
Figure 22:
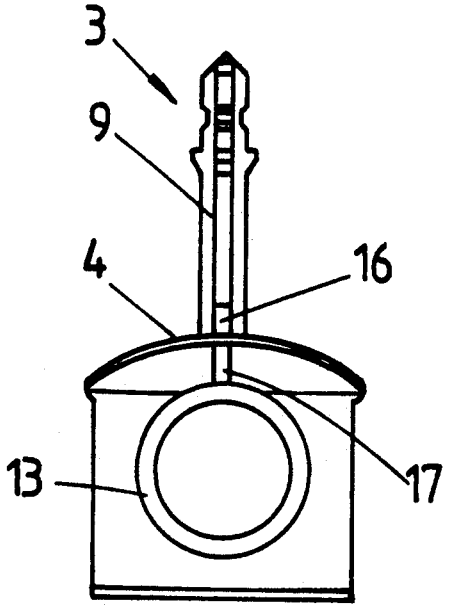
FIG. 22 shows a front view of the slide according to FIG. 21.
Figure 27:
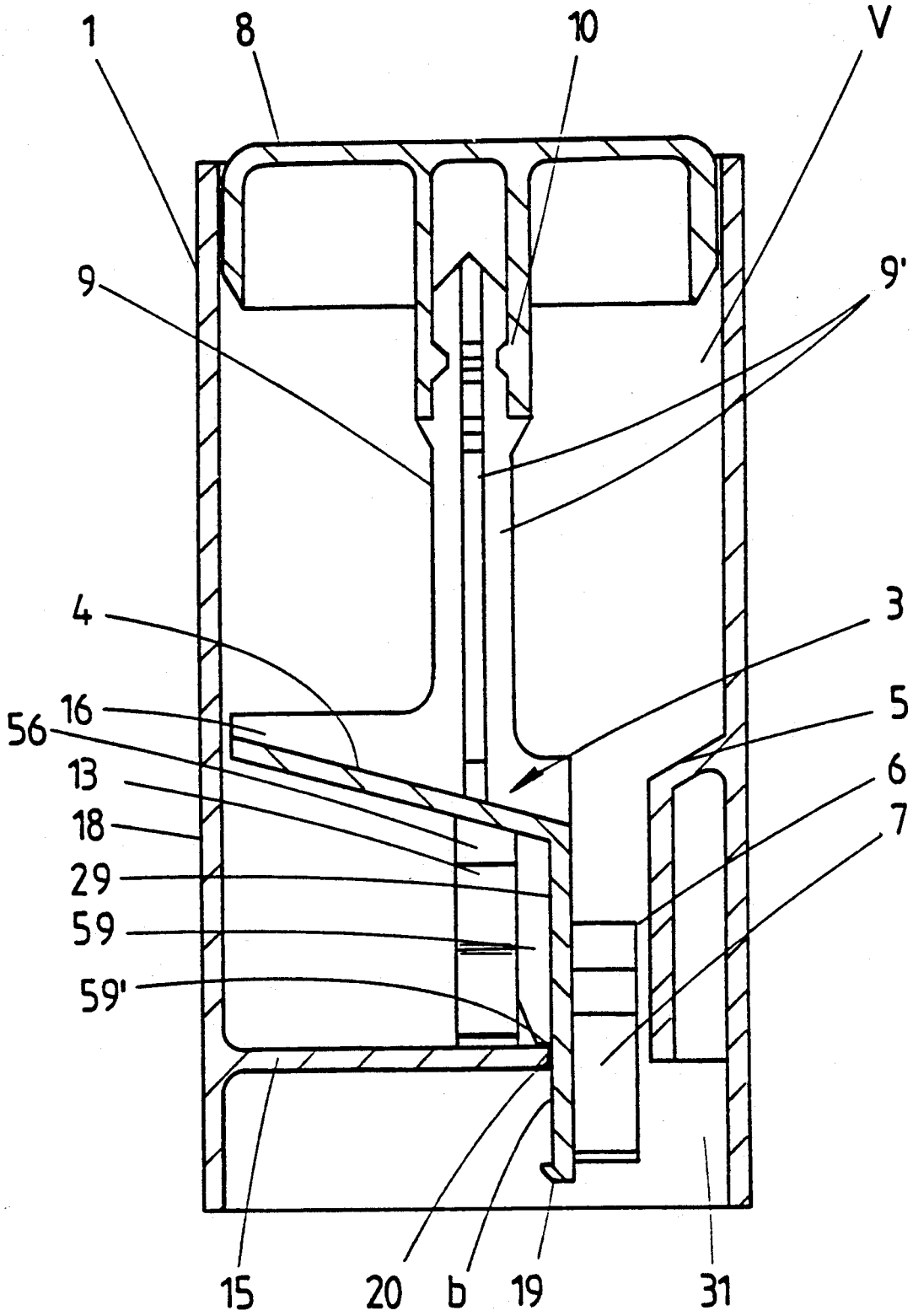
FIG. 27 is a section corresponding to FIG. 23, but in dispensing actuation and on an enlarged scale.

FIGS. 21 and 22 show an alternative embodiment of the slide. This embodiment of the slide 3 is characterized by a restoring spring 13 which has a profile closed on itself in the shape of a circle. The restoring spring 13 in the form of a closed circle is formed on directly behind the closure wall b. The restoring spring for this particular development has practically the action of a double spring. A strong spring action can be achieved with little space requirement.

Figure 15:
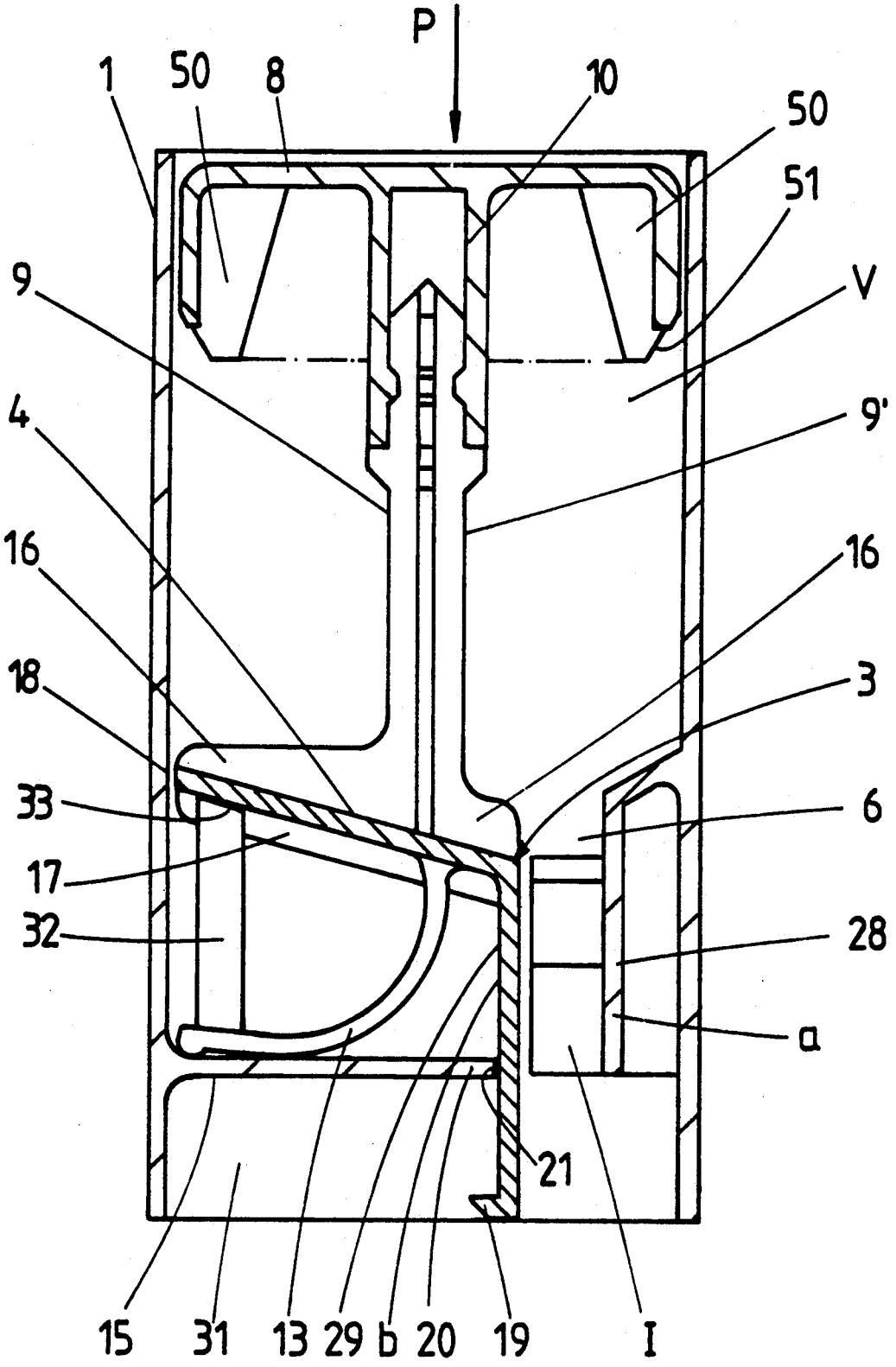
FIG. 15 is a section according to FIG. 12, but during the dispensing and on an enlarged scale.
Figure 20:
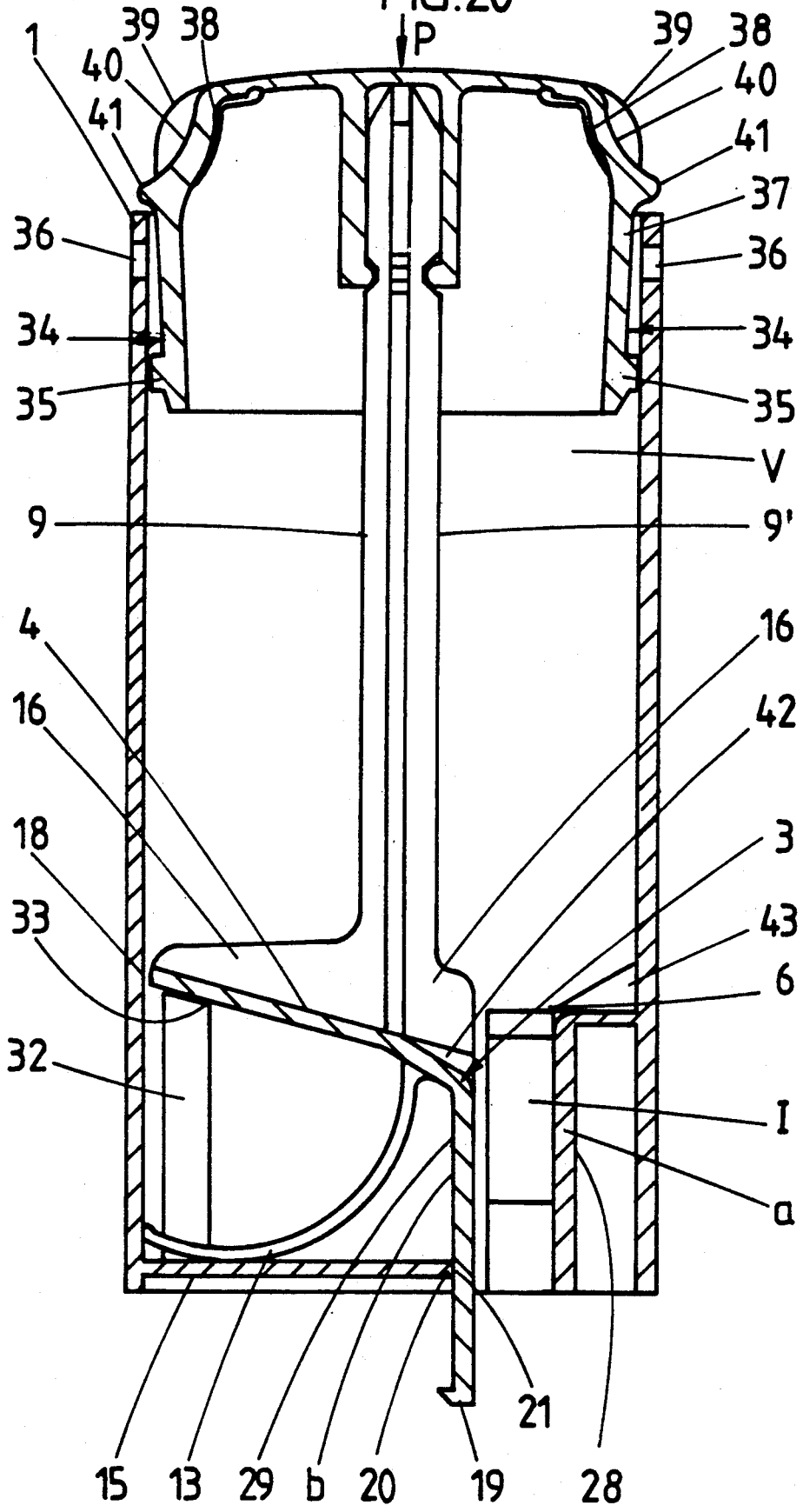
FIG. 20 shows a section similar to FIG. 16 but during the dispensing and on an enlarged scale.

It can be noted from the embodiments according to FIGS. 12 and 15 that stiffening ribs 50 are developed below the actuating button 8. These stiffening ribs 50 have an inclination 51 which widens with respect to the housing 1. This inclination is of particular importance with respect to the assembly of the dispenser, which must be effected, at least in part, practically as a blind assembly.

The embodiment of the dispenser according to FIGS. 23–27 remains in principle unchanged; the reference numbers are entered by analogy, without, however, recourse to repetitions in the text. The further developments refer to the return spring 13 and the limiting stop means for the slide 3.

With respect to the return spring 13, it is of rhomboid shape, as is clearly evident from FIG. 26. The spring body is completely closed, the same way as the circular spring described above. The force of deformation leads to a flat folding. One vertex 52 of the four-cornered spring body points downward, i.e. in the direction of the transverse wall 15 of the housing 1.

As can be clearly noted from FIG. 26, the vertex 52 facing the transverse wall 15 is pulled into the inside of the spring in order to form a bearing niche 53 which is open towards the bottom. Into the bearing niche, there engages an upward-directed bearing knife-edge 54, which is developed on the transverse wall 15. In this way, there is no movement of evasion from the correct functioning position of the return spring 13, which advisedly has a slight initial tension in the attached state.

The vertex 55 of the rhomboid-shaped return spring 13, which faces away from the transverse wall 15 and lies spaced above the vertex 52, passes via a vertically extending arm 56 into the lower side of the slide bottom 4. The width of the arm corresponds to that of the band of the return spring 13. This width corresponds essentially to the tablet thickness.

The other vertices of the return spring are designated 57 and 58. They form the spring knee of the double spring which is developed in this way and is located in space in the plane of the shaft of the slide 3.

With regard now to the second element of the further development, namely the stop-limiting means, the fourth as well as the fifth embodiments have a stop ledge 59. It is formed at the same time directly by extrusion on the slide 3. It extends axially, i.e. in the direction of displacement of the slide, extending in the region of the above-described closure surface b. As shown, it is provided in pairs. Both stop ledges, protruding perpendicular to the closure surface b, are connected to this closure surface and, at the same time, are connected in corner-stiffening manner with the slide bottom 4 which is adjacent thereto on top and drops down in ridge-shaped manner. They act like stiffening struts. The place of the limiting stop forms the lower front surface 59' of the two stop ledges 49. This front surface 59' strikes against the top of the transverse wall 15 of the housing 1. The stroke of the slide is in this way precisely defined. A particularly balanced limiting of the slide 3 results, in particular, in the manner that the stop ledges 59 lie in the lateral end-regions of the closure surface b (see FIG. 25).

The fifth embodiment differs with respect to the return spring 13 insofar as in that case it is not the annular or rhomboid-shaped closed spring body which is used, but the leaf spring used in the preceding examples.

A new feature is present in the fifth embodiment also, in the manner that in that case the slide 3 bears on its shank a guide wing 60 which exerts a centering action. It extends directed radially from the shaft of the slide 3 and has an axial extent, i.e. an extent lying in the direction of displacement of the slide. The actual guide surface is formed by the longitudinal end-surface 60' of the guide wing 60, which end surface rests against the inner wall of the housing 1.

Figure 32:
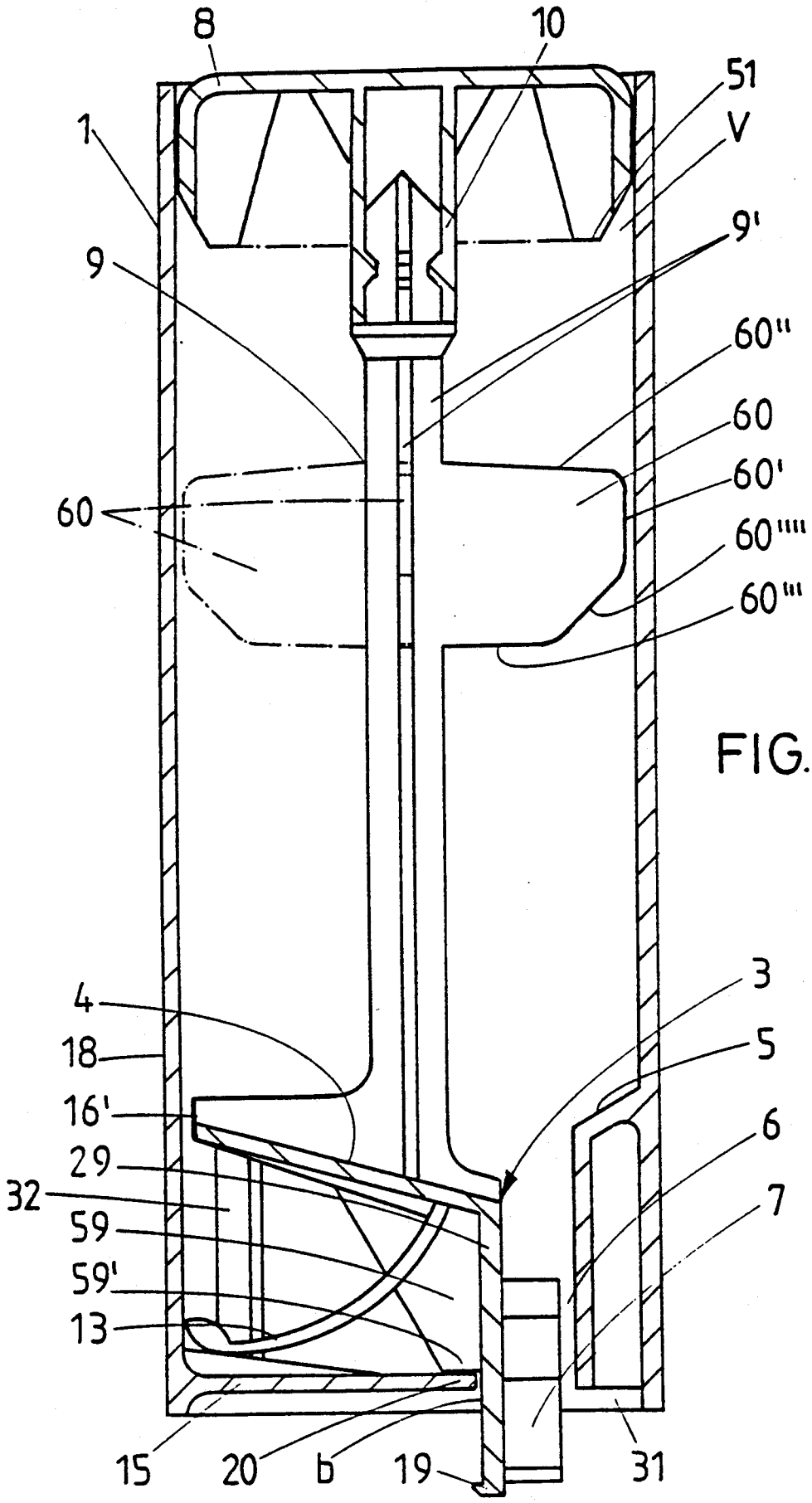
FIG. 32 is a section corresponding to FIG. 28, but in dispensing actuation and on an enlarged scale.

As can be clearly noted from FIG. 28, the guide wing 60 passes from the side of the shaft of the slide 3, facing the separation chamber A but can, however, continue in corresponding fashion on the other side. In addition to such a double-sided wing arrangement, a triple or even a quadruple arrangement is also possible, in the manner that such guide wings 60 proceed in radial direction simultaneously from all four crosswise arms 9' of the actuating shaft 9 (see FIG. 32, showing in dash-dot line). The guide wing 60 is located in diametral, although, to be sure, vertically spaced, opposition to the ledge 16 formed on the upper side of the slide bottom 4. The ledge rests by its vertical end-surface 16' also in guiding application against the inner surface of the housing. The guide wing 60 extends in the upper free end region of the shaft of the slide 3, which is connected in clip-like fashion to the actuating button 8. Due to the centering action of the guide wing 60, the actuating button 8 always finds the assembly-correct position. There is no incorrect association due to a tilted position of the slide 3 in the housing 1. As soon as the end surface 59' of the stop ledges have come against the transverse wall 15, the clipping forces can be overcome.

The upper edge 60'' and lower edge 60''' of the guide wing 60 assume a slightly convergent course towards the outside, which is favorable from the standpoint of mold removal. Furthermore, the lower edge is beveled. The beveling is marked 60''''. It reduces the guide-active or support-active length of the longitudinal end-surface 60' approximately to ½ of the height of the guide wing 60. All vertex edges can be rounded, so that smooth, non-catching travel results. Since upon the actuation of the slide, the guide wing or wings 60 shift together with the slide bottom 4, there is also no mechanical loading on the tablet; the guide wings 60 move up and down together with the tablets.

All new features mentioned in the specification and shown in the drawing are essential to the invention even if they have not been expressly set forth in the claims.

We claim:

1. A dispenser for dispensing individual tablets, the dispenser comprising a housing, and a displaceable slide operable with limited stroke in the housing;

a tablet storage chamber with adjoining delivery chute located in the housing, there being front end closure surfaces and profiled flanks formed, in part, fixed on the housing as a fixed flank and, in part, fixed on the slide as a movable flank, a separation chamber developed in the moveable flank;

a separation finger operable with the separation chamber and formed extending from the fixed flank which is fixed on the housing;

wherein the separation finger comprises a vertex on the bottom side of a first oblique surface which commences on top opposite an upper closure of the separation chamber; and a second oblique surface is developed on the moveable flank fixed to the slide, the second oblique surface commencing at the upper closure of the separation chamber and extending in upward direction and continuously increasing the cross-section of the delivery chute, said oblique surfaces arranging the tablets in a common plane with each tablet being supported by a lower tablet, and said second oblique surface has a nose-like corner which engages a next tablet to be dispensed below a horizontal diameter of said next tablet only when the second oblique surface has moved under said next tablet.

2. A dispenser according to claim 1, wherein the separation chamber is formed with a run-off bevel; and the run-off bevel and the first oblique surface together form in cross section a closed funnel in the dispenser with the slide in a basic non-dispensing position, the latter being its position prior to a depressing movement of the slide in a direction of dispensing of the tablets.

3. A dispenser according to claim 2, wherein said first oblique surface and the second oblique surface form respectively a first and a second acute angles with a central plane of a shaft of the dispenser, the second acute angle being smaller than the first acute angle.

4. A dispenser according to claim 3, wherein the run-off bevel forms with a central plane of the shaft of the dispenser a third acute angle which is larger than said first acute angle.

5. A dispenser according to claim 1, wherein said second oblique surface and the first oblique surface form, in actuated condition of the dispenser, and in cross section, a funnel which is closed to an extent less than a diameter of a tablet.

6. A dispenser according to claim 1, wherein said delivery-chute has a limiting-surface fixed to the housing; and the chute limiting surface extends vertically, and adjoins the first oblique surface in upward direction and lies opposite the second oblique surface in non-actuated condition of the dispenser.

7. A dispenser according to claim 1, further comprising a bottom of said slide located on the storage-chamber side and extending about two-thirds of the cross section of the storage chamber;

an actuating button formed as a cover of the dispenser;

a central actuating shaft connected to the button; and wherein the slide is connected via the central actuating shaft to the actuating button; and a side wall of the storage chamber is formed by the housing.

8. A dispenser according to claim 7, wherein said actuating shaft has a cross-shaped cross section.

9. A dispenser for dispensing individual tablets, the dispenser comprising a housing, and a displaceable slide operable with limited stroke in the housing;

a tablet storage chamber with adjoining delivery chute located in the housing, there being front end closure surfaces and profiled flanks formed, in part, fixed on the housing as a fixed flank and, in part, fixed on the slide as a movable flank, a separation chamber developed in the moveable flank;

a separation finger operable with the separation chamber and formed extending from the fixed flank which is fixed on the housing;

wherein the separation finger comprises a vertex on the bottom side of a first oblique surface which commences on top opposite an upper closure of the separation chamber; and a second oblique surface is developed on the moveable flank fixed to the slide, the second oblique surface commencing at the upper closure of the separation chamber and extending in upward direction and continuously increasing the cross-section of the delivery chute;

a bottom of said slide located on the storage-chamber side and extending about two-thirds of the cross section of the storage chamber;

an actuating button formed as a cover of the dispenser;

a central actuating shaft connected to the button; and wherein the slide is connected via the central actuating shaft to the actuating button; and a side wall of the storage chamber is formed by the housing;

said actuating shaft has a cross-shaped cross section;

said slide bottom has a ledge which divides the slide bottom on the storage chamber side; and two legs of the cross of the actuating shaft pass into said ledge.

10. A dispenser according to claim 9, wherein the slide bottom is formed as a trough; and the ledge extends in descending fashion on the bottom of the trough, namely in direction of the delivery chute, and is aligned coplanar with the latter.

11. A dispenser according to claim 9, wherein said slide has a vertical wall below the slide bottom and is aligned with the ledge, which wall is guided with its peripheral longitudinal edge on the corresponding inner surface of the housing.

12. A dispenser for dispensing individual tablets, the dispenser comprising a housing, and a displaceable slide operable with limited stroke in the housing;

a tablet storage chamber with adjoining delivery chute located in the housing, there being front end closure surfaces and profiled flanks formed, in part, fixed on the housing as a fixed flank and, in part, fixed on the slide as a movable flank, a separation chamber developed in the moveable flank;

a separation finger operable with the separation chamber and formed extending from the fixed flank which is fixed on the housing;

wherein the separation finger comprises a vertex on the bottom side of a first oblique surface which commences on top opposite an upper closure of the separation chamber; and a second oblique surface is developed on the moveable flank fixed to the slide, the second oblique surface commencing at the upper closure of the separation chamber and extending in upward direction and continuously increasing the cross-section of the delivery chute;

a transverse wall, and a spring for restoring a position of the slide; and wherein the housing is closed on its bottom, except for an opening for a head of the slide, by said transverse wall; and the top side of the transversal wall forms a support for the restoring spring, the spring being formed on the slide and developed as a leaf spring.

13. A dispenser for the dispensing of individual tablets, the dispenser comprising a housing and a displaceable slide located in the housing;

a tablet storage chamber located in the housing and communicating with the slide, the tablet storage chamber communicating with an adjoining delivery chute;

front end closure surfaces and profiled flanks formed in part, fixed on the housing as a fixed flank and, in part, fixed on the slide as a movable flank to provide a separation chamber;

a second oblique surface is developed on the moveable flank, the second oblique surface commencing at the upper closure of the separation chamber and extending in upward direction and continuously increasing the cross-section of the delivery chute, said oblique surfaces arranging the tablets in a common plane with each tablet being supported by a lower tablet, and said second oblique surface has a nose-like corner which engages a next tablet to be dispensed below a horizontal diameter of said next tablet only when the second oblique surface has moved under said next tablet;

detent elements on an actuating button of the slide for engagement in safety recesses of the housing in non-dispensing condition of the dispenser; and wherein the detents are disengageable from the safety recesses substantially perpendicular to a direction of displacement of the slide against spring force.

14. A dispenser for the dispensing of individual tablets, the dispenser comprising a housing and a displaceable slide located in the housing;

a tablet storage chamber located in the housing and communicating with the slide, the tablet storage chamber communicating with an adjoining delivery chute;

front end closure surfaces and profiled flanks formed in part, fixed on the housing and, in part, fixed on the slide to provide a separation chamber;

detent elements on an actuating button of the slide for engagement in safety recesses of the housing in non-dispensing condition of the dispenser; and wherein the detents are disengageable from the safety recesses substantially perpendicular to a direction of displacement of the slide against spring force;

said actuating button is for displacing the slide; and wherein the detent elements are formed by lugs cut free from the actuating button, the button being cup-shaped.

15. A dispenser according to claim 14, wherein there is a convex transition region from cup bottom to cup wall of said actuating button, the dispenser including concave actuating hollows formed on the lugs in said transition region of the button.

16. A dispenser according to claim 15, wherein each actuating hollow ends in a protruding limiting bead on the cup-wall side of said actuating button, the bead extending into a region of a projection of the housing wall.

17. A dispenser for the dispensing of individual tablets, the dispenser comprising a housing and a displaceable slide located in the housing;

a tablet storage chamber located in the housing and communicating with the slide, the tablet storage chamber communicating with an adjoining delivery chute;

front end closure surfaces and profiled flanks formed in part, fixed on the housing and, in part, fixed on the slide to provide a separation chamber;

detent elements on an actuating button of the slide for engagement in safety recesses of the housing in non-dispensing condition of the dispenser; and wherein the detents are disengageable from the safety recesses substantially perpendicular to a direction of displacement of the slide against spring force;

said detent elements are formed at diametrically opposite places.

18. A dispenser for the dispensing of individual tablets, the dispenser comprising a housing and a displaceable slide located in the housing;

a tablet storage chamber located in the housing and communicating with the slide, the tablet storage chamber communicating with an adjoining delivery chute;

front end closure surfaces and profiled flanks formed in part, fixed on the housing and, in part, fixed on the slide to provide a separation chamber;

detent elements on an actuating button of the slide for engagement in safety recesses of the housing in non-dispensing condition of the dispenser; and wherein the detents are disengageable from the safety recesses substantially perpendicular to a direction of displacement of the slide against spring force;

a restoring spring for restoring the slide to a basic non-dispensing position upon deactivation of the dispenser; and the restoring spring is shaped closed on itself in the shape of a circle.

19. A dispenser for the dispensing of individual tablets, the dispenser comprising a housing and a displaceable slide located in the housing;

a tablet storage chamber located in the housing and communicating with the slide, the tablet storage chamber communicating with an adjoining delivery chute;

front end closure surfaces and profiled flanks formed in part, fixed on the housing and, in part, fixed on the slide to provide a separation chamber;

detent elements on an actuating button of the slide for engagement in safety recesses of the housing in non-dispensing condition of the dispenser; and wherein the detents are disengageable from the safety recesses substantially perpendicular to a direction of displacement of the slide against spring force;

a restoring spring for restoring the slide to a basic non-dispensing position upon deactivation of the dispenser;

the dispenser includes a transverse wall partially closing a bottom of the dispenser; and the restoring spring is developed as a closed rhombus, with vertex resting on the transverse wall.

20. A dispenser according to claim 19, further comprising a bearing knife-edge bead on the transverse wall; and the vertex faces the transverse wall and is drawn in to form a bearing niche which seats on the bearing knife-edge bead of the transverse wall.

21. A dispenser according to claim 19, further comprising an arm extending vertically from a bottom side of said slide to the spring; and wherein the spring has a vertex which faces away from the transverse wall and connects via the vertically extending arm to the bottom side of the slide.

22. A dispenser for the dispensing of individual tablets, the dispenser comprising a housing and a displaceable slide located in the housing;

a tablet storage chamber located in the housing and communicating with the slide, the tablet storage chamber communicating with an adjoining delivery chute;

front end closure surfaces and profiled flanks formed in part, fixed on the housing and, in part, fixed on the slide to provide a separation chamber;

detent elements on an actuating button of the slide for engagement in safety recesses of the housing in non-dispensing condition of the dispenser; and wherein the detents are disengageable from the safety recesses substantially perpendicular to a direction of displacement of the slide against spring force;

the dispenser includes a transverse wall partially closing a bottom of the dispenser; and said slide has a closure surface, and bears in a region of its closure surface, a stop ledge which cooperates in a slide-stroke-limiting manner with the transverse wall.

23. A dispenser according to claim 22, further comprising additional ones of said stop ledge; and wherein said stop ledges are provided in pairs which stand perpendicular to the closure surface and are rooted in it, and at the same time are rooted in a corner-stiffening manner in a bottom of said slide which adjoins them on top.

24. A dispenser according to claim 23, wherein the stop ledges lie in lateral end-regions of the closure surface.

25. A dispenser for the dispensing of individual tablets, the dispenser comprising a housing and a displaceable slide located in the housing;

a tablet storage chamber located in the housing and communicating with the slide, the tablet storage chamber communicating with an adjoining delivery chute;

front end closure surfaces and profiled flanks formed in part, fixed on the housing and, in part, fixed on the slide to provide a separation chamber;

detent elements on an actuating button of the slide for engagement in safety recesses of the housing in non-dispensing condition of the dispenser; and wherein the detents are disengageable from the safety recesses substantially perpendicular to a direction of displacement of the slide against spring force;

a shaft extending vertically to contact the slide for displacing the slide; and wherein the shaft of said slide bears an axially extending, radially directed guide wing having a longitudinal end surface which rests against an inner wall of the housing.

26. A dispenser according to claim 25, wherein the guide wing extends from that side of the shaft of said slide which faces the separation chamber.

27. A dispenser according to claim 25, wherein the guide wing lies in an upper region of the shaft of said slide.

28. A dispenser according to claim 25, wherein said guide wing has upper and lower edges which converge slightly outwards, the guide wing having a lower vertex which is beveled.

* * * * *